US011088502B1

(12) United States Patent
Tillotson, Jr.

(10) Patent No.: US 11,088,502 B1
(45) Date of Patent: Aug. 10, 2021

(54) WIRE TERMINATION ASSEMBLY STATION AND UNIVERSAL APPLICATOR FOR INSULATION DISPLACEMENT (IDT) STRIP TERMINALS AND CONNECTORS THEREFOR

(71) Applicant: John D Tillotson, Jr., Scottsdale, AZ (US)

(72) Inventor: John D Tillotson, Jr., Scottsdale, AZ (US)

( * ) Notice: Subject to any disclaimer, the term of this patent is extended or adjusted under 35 U.S.C. 154(b) by 0 days.

(21) Appl. No.: 17/121,699

(22) Filed: Dec. 14, 2020

(51) Int. Cl.

| | |
|---|---|
| ***H01R 43/052*** | (2006.01) |
| ***H01B 13/012*** | (2006.01) |
| ***H01R 43/01*** | (2006.01) |
| ***H01R 43/28*** | (2006.01) |
| ***H01R 43/042*** | (2006.01) |
| ***H01R 43/045*** | (2006.01) |
| ***H01B 13/00*** | (2006.01) |

(52) U.S. Cl.
CPC ..... *H01R 43/052* (2013.01); *H01B 13/0003* (2013.01); *H01B 13/01236* (2013.01); *H01R 43/01* (2013.01); *H01R 43/045* (2013.01); *H01R 43/0422* (2013.01); *H01R 43/0425* (2013.01); *H01R 43/28* (2013.01); *Y10T 29/53217* (2015.01); *Y10T 29/53243* (2015.01)

(58) Field of Classification Search
CPC ..... H01B 13/0003; H01B 13/01236; H01R 43/01; H01R 43/0422; H01R 43/0425; H01R 43/045; H01R 43/052; H01R 43/28; Y10T 29/53217; Y10T 29/53243
See application file for complete search history.

(56) References Cited

U.S. PATENT DOCUMENTS 3,599,308 A * 8/1971 Fielder ..... H01R 43/0422 29/751
4,594,776 A * 6/1986 Anderson ..... H01R 43/01 29/749

FOREIGN PATENT DOCUMENTS

JP 2017004596 A * 1/2017

* cited by examiner

*Primary Examiner* — A. Dexter Tugbang

(57) ABSTRACT

A wire harness assembly work cell includes a wire harness assembly work table with a pneumatically powered or spring-fed universal applicator tool for mass terminating sets of wires into insulator wafers. The insulator wafers may be assembled in stacks to form cable-end connector headshells. Insulation displacement terminals (IDT) are designed to receive wide ranges of wire diameters so that larger varieties of wire sizes may be received into these connector assemblies while using fewer different sizes of terminals, thus reducing the number of items in a bill of material (BOM) and substantially reducing the volumes and overhead costs of testing and quality control documentation dedicated to each individual BOM item.

8 Claims, 13 Drawing Sheets

WIRE TERMINATION ASSEMBLY STATION AND UNIVERSAL APPLICATOR FOR INSULATION DISPLACEMENT (IDT) STRIP TERMINALS AND CONNECTORS THEREFOR

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention generally relates connector assembly fixturing and machinery and mechanical devices and aids for increasing assembly productivity of electrical connectors and wire harnesses which have electrical connectors at their various ends.

BACKGROUND OF THE INVENTION

Manufacturers of discrete wire harness assemblies must usually arrange to provide an extensive inventory of components that require high labor content to assemble in order to produce acceptable finished products to their OEM customers. Labor-intensive tasks commonly include selecting and handling correct wires types and sizes, and selecting from a myriad of loose piece components such as connector housings, hardware, clips, terminals, all of from among large numbers of bulk supplies. Other tasks include pulling wire and routing groups of wires around pegs and other such layout fixtures to establish proper lengths for each wire of a product being manufactured, inserting wires into terminal and jacket crimping and forming machines, and snapping or inserting terminated wires into proper cavities of cable end connector housings, or arranging groups of wires cables onto insulation-displacement devices and mass-terminating these groups using an arbor press or some other high-force machine.

Thus cable assembly work entails much dexterity, attention to details, fine finger work, the ability to follow complex assembly and testing instructions, and to react correctly as these instructions are changed to follow various and flexible production schedules. Wire harness manufacturing entails an intense amount of complex and detailed work, all of which must be executed competently and correctly.

Thus opportunities exist and will continue to exist for reducing labor costs by simplifying tasks, providing machines that can execute sets of similar functions simultaneously, and machinery of fixtures which are easy to re-configure so that flexible manufacturing work cells may convert from one setup to the next with less time, less effort, and while minimizing the opportunity for manufacturing errors.

BRIEF SUMMARY OF THE INVENTION

From the aforementioned background it is understood that many objectives exist. A primary objective of the invention is to arrange and provide a configurable fixture for use within a work station to assist with pulling wires, cutting them to required lengths, and preparing wire ends such as by stripping off insulation jackets or by crimping terminals to wire ends.

Since the largest portion of the expense in producing a wire harness assembly is in the management of so many different wires and leads, another objective of the invention is to reduce a unit cost of the harness produced in the work station by enabling mass terminations or in-gang assemblies of similar or sufficiently identical components so that a single action of an application-specific machine or tool may correctly and completely execute a plurality of similar or identical assembly steps in several closely collected locations. Thus another objective of the invention is to enable pulling and cutting to length of appropriate wires in sets of two or more wires at a time.

Another objective of the invention is to provide assembly fixtures and aids which simplify or eliminate steps in the processes of applying terminals to prepared wire ends, inserting terminated wire ends into insulator housings, and combining connector subassemblies to form completed connectors at appropriate wire harness locations.

Yet another objective of the invention is to provide for electrical testing and verification of terminals while they are affixed to wire ends but before they have been fully and permanently inserted into their insulator housings.

Combined with a capability to perform more than one identical task in a single space, it is therefore an additional objective of the invention to arrange all assembly and process infrastructures in a smaller space and volume than current methodologies typically require and consume.

From the foregoing, there is also seen a need for streamlining the process for changing over a set-up for making one assembly to a configuration for making a different assembly. Universal, programmable tooling may then effect substantial cost savings over current manufacturing operations. Various devices are currently available which attempt to address these challenges, although they may at best meet only one or two aspects of the totality of the requirements.

BRIEF DESCRIPTION OF THE DRAWINGS

A further understanding of the nature and advantages of particular embodiments may be realized by reference to the remaining portions of the specification and the drawings. Similar reference numerals are used to refer to similar components.

DETAILED DESCRIPTION OF THE INVENTION

Figure 1A:
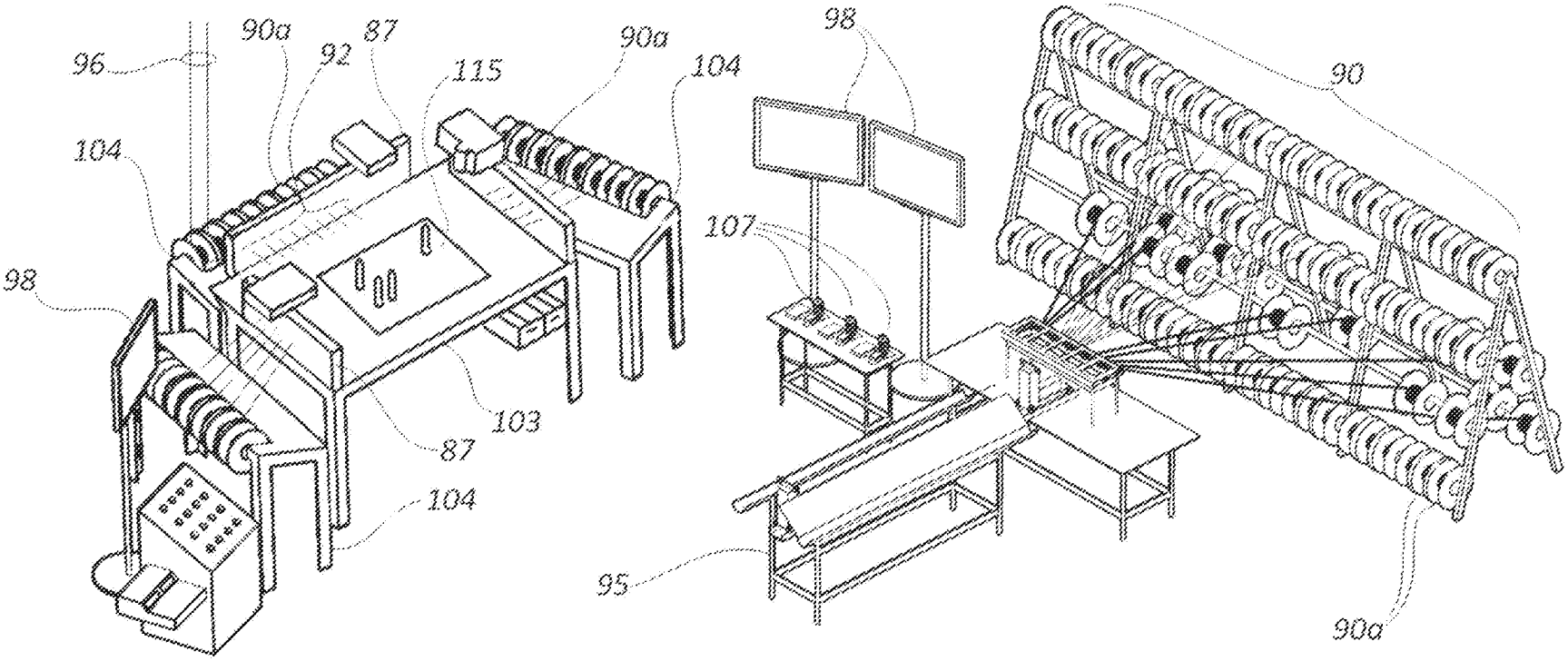
FIG. 1*a* shows a cable assembly work center which includes assembly machinery in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this specification, the term "means for . . . " as used herein including the claims, is to be interpreted according to 35 USC 112 paragraph 6. In method claims, a step said to be performed "after" a prior step may be performed immediately after the prior step, or it may be performed after other intervening steps are also performed after the prior step.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise. The word "by" in this specification not only means "by means of" in some instances in this specification and claims, but in other instances "by" is a preposition also meaning "at," "in the vicinity of," or "next to."

In this specification the word "substantially" when used as a comparative, such as a first quantity, parameter, or geometric entity being "substantially equal to" or "substantially parallel to" or "substantially perpendicular to" a second quantity, parameter, or geometric entity shall be taken to mean that for numerical values the second value resides within 10% of the first value and for angular measures the second entity resides within 10° of the condition referencing the first entity.

Also in this specification the word "wire" may be used interchangeably with the word "cable" when meaning a single strand structure comprising a solid or a stranded central conductor surrounded by an insulating coating or a jacket. A "wire" in this specification may have a solid central conductor or a braided or served strand built up from a plurality of solid conductors. Some wires have a built-up core of multiple conductors, with each individually coated with a solder or a brazing material which is heated to bond the group to act as a unitary conductor. Also in this specification, where the word "terminal" or its plural is used without any other adjacent word defining or limiting the scope or type of terminal, then the word applies to all types of terminals and all manners of bulk supplies of these terminals, such as side feed, end feed, and loose piece terminals. As the wires are drawn and cut to length by the invention material moves from bulk stores, through guiding devices such as fairleads and infeed guides, through clamps, outfeed guides, and wire cutters. The direction of material motion over time allows the use of relative words used to describe sequences in time such as "before" and "after" and words describing relative positions in a flow such as "ahead of," "upstream," and "downstream" to be used to describe the relative positions or sequences of components within a series of elements spaced out along a length of wire set up and threaded through the inventive machine.

During cable and wire harness assembly, fixtures are often used for assembling wire harnesses for nearly any industry, the devices and their arrangements as disclosed in this document may offer some of their greatest benefits and improvements to wire harness assembly in the automotive industry. Wire and lead production may proceed at a rate of more than 3,000 wires or leads per hour, and may include tasks such as handling wires of different gauges, different lengths, different colors, or having different terminals crimped to them, and other variations in accordance with customer requirements. A significant amount time is consumed in handling wires from the time they are produced to the time they are assembled on the harness boards and finally packaged and shipped. The time defined by movement of one cut wire length from one place to another is referred to as "in-process inventory movement" of wires or leads. Inventory retained for a long period of time has an inherent cost where return on investment is affected. By reducing in-process inventory time in the manufacturing cycle, the end cost of a completed wire assembly may also be effectively reduced, when compared to a conventional production arrangement as described in patent application Ser. No. 16/133,466 for its FIGS. 1 and 4a.

Now referring to the figures, FIG. 1*a* shows a work center which includes assembly machinery in accordance with the invention, especially a wire termination assembly station and universal applicator in accordance with the invention. The work station shown includes termination tools or machines for terminals supplied in bulk such as side feed, end feed, and tape mounted terminals. The work cell is a configurable modular work space where assembly tools, jigs and fixtures, and machinery may be arranged for production and verification testing of various wire harness assemblies, wherein the modules and work spaces within the work cell may be rapidly, easily, and safely rearranged for most efficient production of a product to OEM or customer specifications.

Discrete wire termination stations have wire end applicator machines [107] which may be configured to process many types of wire terminals, including but not limited to end feed terminals, side feed terminals, loose terminals, and tape mounted terminals. Cost saving benefits include that the use of universal applicator tooling may eliminate a need to purchase or lease dedicated application tooling, and manufacturing time savings during setup or to transition from one terminal strip to another.

Although bulk quantities of wire are available in spools, tubs, boxes, or barrels, in this illustration wires are shown in spools [90*a*] arranged on a bulk supply frame [90.] Bulk wire supplied by barrel may contain up to 17 miles of wire per barrel. Wires of various types and sizes are pulled from bulk supplies and routed to a programmable discrete wire inventory indexing system. The wires may be retained by insertion into gaps of an extended helical spring as is explained and illustrated below. Other bulk stores of wire may be located beneath the work center tables or may be located overhead or in an upper floor warehouse and routed from above as in [96.]

Computers and video display monitors [98] are positioned at work areas and component storage areas and in view of workers at activity stations within the work cell. Display monitors may indicate inventory on hand and may be part of a kanban system for more automated inventory replenishment or a heijunka system for scheduling "pitches" of work intervals comprising mixed product production.

Predetermined lengths of loose wires are pulled, cut to length, and collected at the presentation table [95.] Cost saving benefits include a capability for multiple wire types to be made available and ready at the assembly site, which reduces in-process inventory time, and time used for wire selection and lead preparation. An assembly workbench or work table [103] in accordance with the invention may include a form board [115] also called a finger board, which includes pegs for routing harness wiring between various cable end connector headshells. Linear arrays of various wire types [92] protrude through back walls [87] and side walls from local bulk stores [104] and spools at the perimeter of the work table, and operators may grab them singly or in groups or sets, which is an action called a "multiple wire pull." Connector assembly and testing as described herein may also be performed within this work area providing further productivity improvements.

Figure 1B:
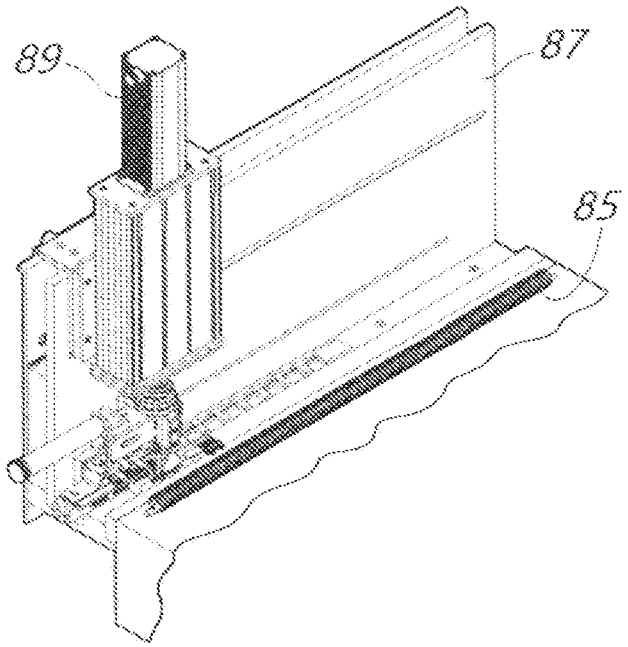
FIG. 1*b* shows a back wall, a movable ram, and other components in accordance with the invention.

FIG. 1*b* shows a back wall [87,] a movable ram [89,] and other components in accordance with the invention. The ram includes a helical ball screw system having a variable pitch helix with a first helical pitch in a first portion or first end of the helix which is larger (i.e, steeper) than a second helical pitch in a second portion or second end of the helix. A long, helical spring [85] having fine-pitch coils assist in laying out sets of wires to be terminated by electrical contacts for connector assembly work.

Figure 1C:
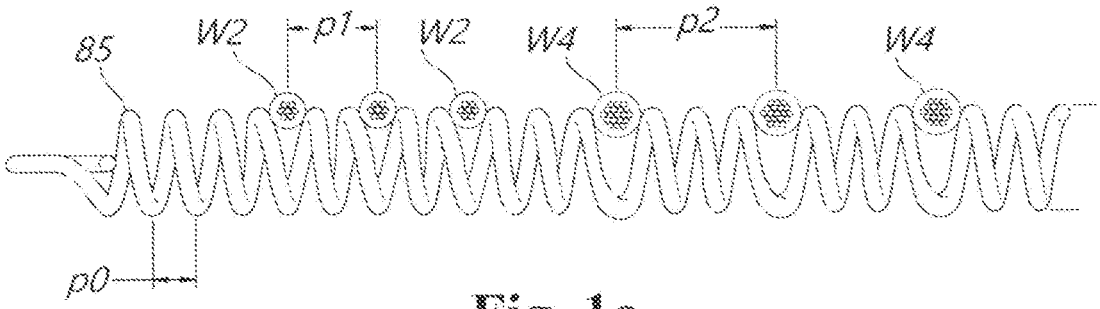
FIG. 1*c* shows a fine-pitch helical spring used to retain wires at various pitches between its coils.

FIG. 1*c* shows a fine-pitch helical spring [85] used to retain wires at various pitches between its coils. The spring [85] secured at both ends and extended so that the helix spreads to a substantially uniform pitch p0. As an assistance for placing wires of various sizes in position for mass termination, the extension of the spring can be set so that for wires of multiple pitches p1 and p2, etc, the pitch of the helix is set to at or near the largest common denominator of the pitches to be terminated. For example, if signal wiring of a size [W2] is spaced at 0.060 in apart (p1) and power wiring of a size [W4] is spaced at 0.090 in apart (p2,) then the spring can be stretched so that the coil pitch and its openings between the coil reside on a pitch p0 of 0.030 in apart.

A fence or a wire stop ahead or behind the extended helical spring may be used to set the longitudinal location of the wire end with respect to the spring. Wire-grabbing fixtures may be adjusted so the fence acts as a wire-end reference, so that such a grabbing fixture may accurately position a wire end in a terminating location, or may insert a wire end to a known depth inside an application specific tool such as a terminal applicator or a wire stripping machine.

Figure 2A:
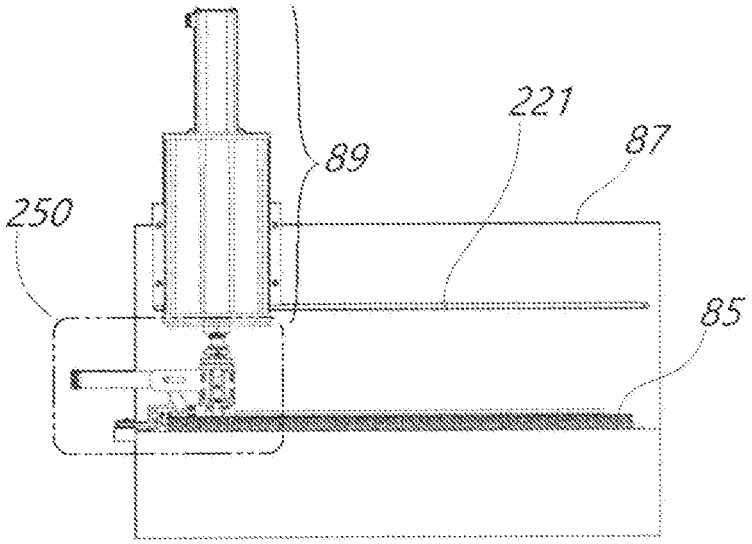
FIG. 2*a* shows a front elevation view of a back wall and a portion of a work station including a universal applicator tool driven by a movable automated vertical ram.

FIG. 2*a* shows a front elevation view of a back wall [87] and a portion of a work station including a universal applicator tool [250] driven by a movable automated vertical ram [89.] In a preferred embodiment, the vertical ram includes a first motor driven power source used for horizontal movement and positioning along the back wall, and a second motor driven power source for raising and lowering its vertically oriented ram rod, which delivers terminal forming forces through to the forming tools affixed to the applicator tool and also delivers mechanical power to cock the applicator's spring-feed mechanism for advancing and separating strip fed terminal form a bulk supply such as terminals furnished on a pilot strip or furnished as mounted on mylar tape. For tape-mounted contacts the applicator tool functions much like a component pick and place machine for populating printed circuit board assemblies. The ram delivers forces and power to form terminals, assemble connectors, advance the connector magazine described further below, and to advance bulk supplies of terminals which may be furnished as side feed or end feed terminal, or tape mounted terminals.

The helical spring [85] for laying out connector leads is positioned along the work table or workbench perimeter and the ram may be translated along the transverse width of the back wall using a top rail and if required, an additional stabilizing or support rail residing within or part of a transverse slot [221] which extends for most of the width of the back wall.

Figure 2B:
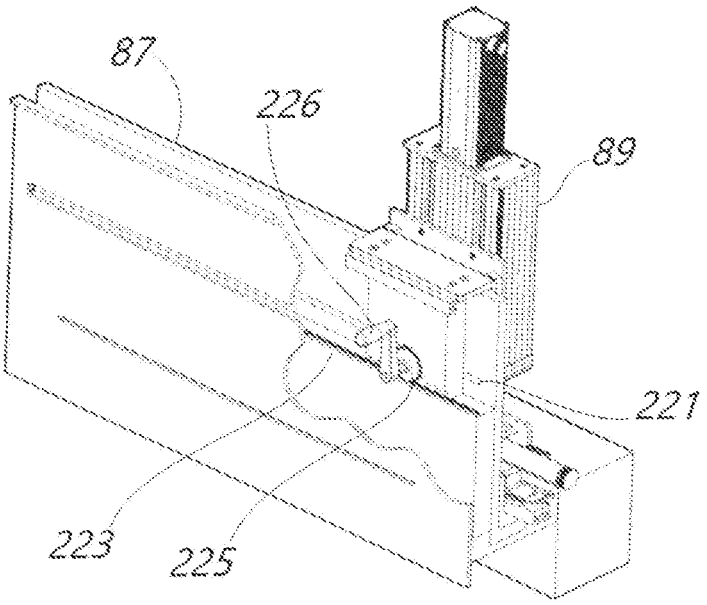
FIG. 2*b* shows an oblique, rear left top view of the of back wall, universal applicator tool and movable automated vertical ram of FIG. 2*a*.

FIG. 2*b* shows an oblique, rear left top view of the of back wall [87,] universal applicator tool, and movable automated vertical ram [89] of FIG. 2*a*. The ram translates along the width of the back wall slot [221] by means of a pinion or spur gear [225] which engages with a toothed rack [223] which resides in the slot. Although in a preferred embodiment the motion of the ram is automatically controlled by a production control computer, it is also possible to manually override or manually position this machine by means of a hand crank [226] affixed to the gear.

Figure 3A:
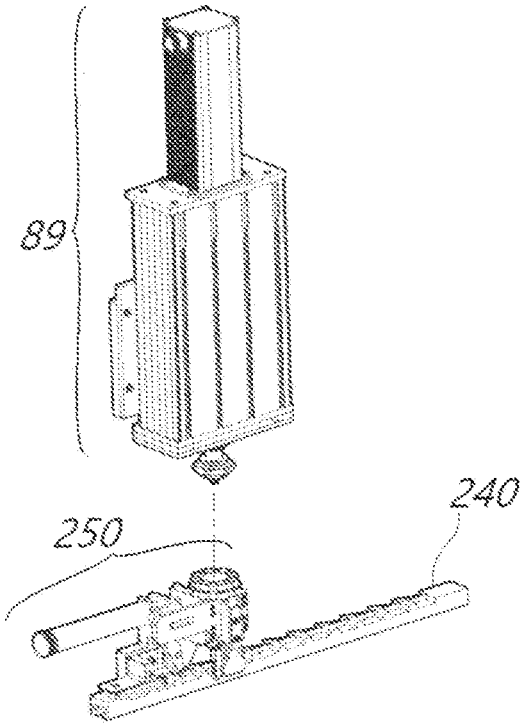
FIG. 3*a* shows an oblique, front left top view of the universal applicator tool and movable automated vertical ram of FIG. 2*a* and also a slidable magazine in accordance with the invention.

FIG. 3*a* shows an oblique, front left top view of the universal applicator tool [250] and movable automated vertical ram [89] of FIG. 2*a* and also a slidable magazine [240] in accordance with the invention. In this figure and some of the following figures, some common hardware such as fasteners and brackets are omitted so that the disclosure may concentrate on more salient and novel components. Nevertheless a tool maker of average skill in this specific art will easily appreciate how to fashion such objects so as to affix and orient the relevant components under discussion with respect to each other.

Figure 3B:
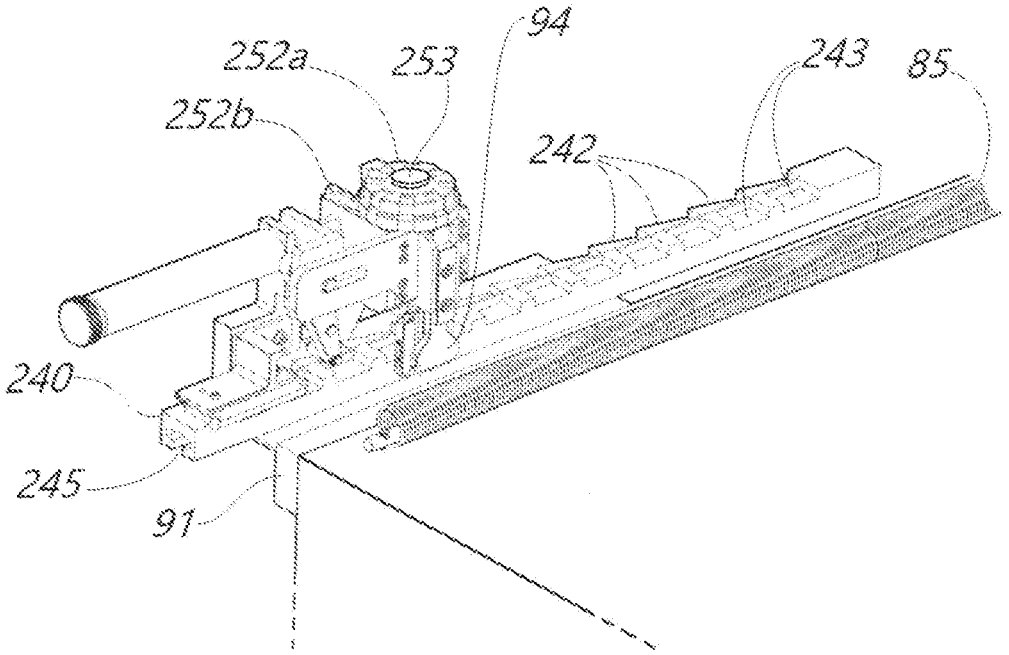
FIG. 3*b* shows an oblique, front left top view of the universal applicator tool abutted to a workbench surface with the wire retaining helical spring nearby to assist laying out of wires to be assembled into connector wafers and headshells.

FIG. 3*b* shows an oblique, front left top view of the universal applicator tool abutted to a workbench surface with the wire retaining helical spring [85] nearby to assist laying out of wires to be assembled into connector wafers and headshells. A spring-fed actuator indexes a connector wafer magazine [240] which includes a T-slot [245] which rides along a T-rail. The magazine includes a linearly spaced set of bays [243] for receiving insulator housings, and a portion having regularly-spaced sawtooth profiles [242] used to index the insulators as they are populated with sets of terminals as these are crimped to their wires by any of various forming and crimping tools [94] held by the applicator tool. These tools operate against an anvil tool [91] comprising a series of crimp forming sites which control shape and dimensions of the underside surface of the crimp wing portions of terminals while the wings are being formed. Another portion of the upper crimping tool forcibly inserts jacketed wires into the insulation displacement terminal (IDT) portion of the terminals which are inserted into the insulator headshells or wafers. Insulation displacement terminals are designed to lacerate wire jackets, expose the central conductive strands, and pinch the conductors securely to establish and maintain reliable electrical interconnections over the service life of the wire harness assembly. By bringing groups of wires to a wire stop in each multiple wire pull from appropriate bulk wire sources, and laying the wires atop the terminals, no wire cutting or trimming is necessary at the IDT terminals. The invention both eliminates individual, one at a time wire pulling and eliminates individual, one at a time wire termination tasks, while also enabling mass termination of groups of wires in a single tool hit with no wire cutting, stripping, tinning, or other wire end preparations being required.

The ram presses down onto a threaded shank [253] seated onto the upper of at least two forming tool height adjusting discs [252*a*] and [252*b*.] According to one set of embodiments in accordance with the invention, the shank passes through and is threadably coupled to the first disc. The lower or lowest of these discs couples to a spring-loaded vertically movable column in the applicator tool by means of precision threads of a first pitch. The next disc above stacks atop the lower disc and couples to it by precision threads of a second pitch which is preferably a fractional pitch compared to the first pitch. The adjustment discs include a radial array of faces marked with indicia and are detented so that when rotated they click-stop at the indicated faces, allowing for very fine adjustment of the lowest stop point of the forming tool. For example, a first disc may have 10 faces around its circumference and be threaded on 2 mm pitch, and a second disc threadingly coupled to the first disc may have its own 10 faces but its thread pitch is 0.2 mm pitch. With both discs detented to click-stop at 36° rotational increments, the faces of the first disc would be marked "0.0," "0.2" etc. to "1.8" and the second disc would be marked "0.00," "0.02" etc. to "0.18." Rotating the first disc from one click-stop to the next adjusts the stop height of the forming tool in 0.2 mm (0.0078 in) increments, with the finer pitch disc adjustable to 0.02 mm (0.0008 in) increments.

The applicator tool may thus be used to effect extremely precise control of forming and crimping operations, especially where overbending or over-compression of materials is required to assure proper and complete plastic deformation and fusion of gas-tight interconnections between conductors. Most metallic conductors accrue an oxide film while exposed to air, so plastic deformation is necessary to stretch and break open this oxide film to expose fresh metal which is immediately and permanently swaged to other freshly exposed metal in adjacent conductors. When performed correctly, permanent compressive forces left behind after such an operation exclude atmospheric corrosion from insinuating new oxide films between these metal to metal junctions, which is the definition of a gas-tight electrical interconnection.

Figure 4A:
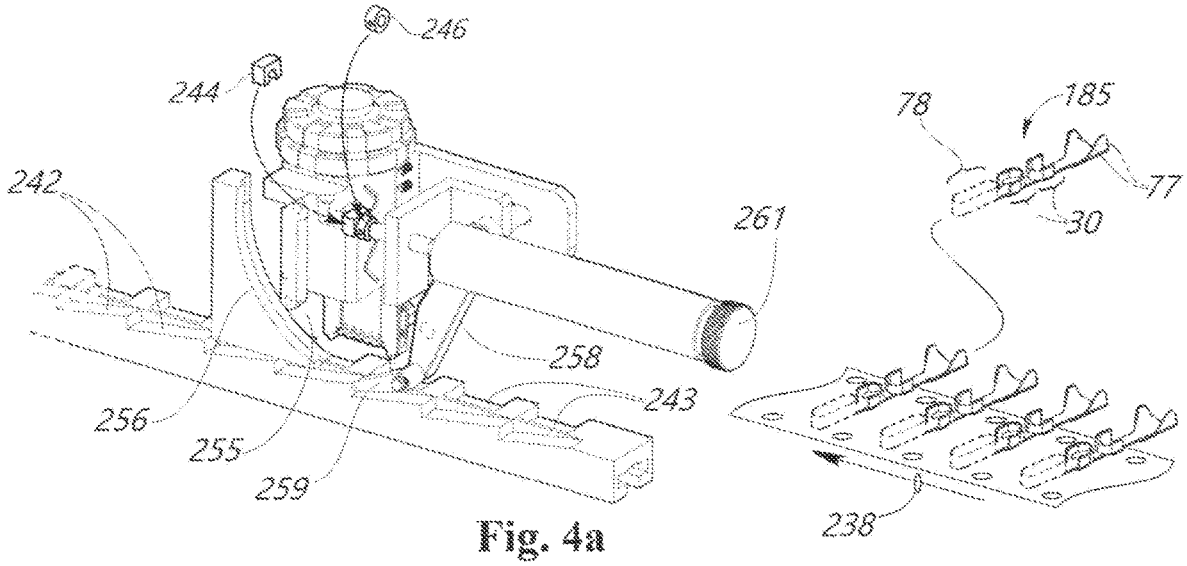
FIG. 4*a* shows a left rear view of an applicator tool atop a connector assembly magazine in accordance with the invention.

FIG. 4*a* shows a left rear view of an applicator tool atop a connector assembly magazine in accordance with the invention. The magazine includes a linearly spaced set of insulator-receiving bays [243] and a portion having regularly-spaced sawtooth profiles [242] used to index the insulators as they are populated with sets of terminals. A cam follower [255] rides along a guide which includes an arcuate profile [256] or "J" so that during the descent of the ram, the follower acquires an angular rotation which rotates a feed spindle to which it is coupled, and the rotation of the feed spindle drives a cocking rod which cocks the spring feed mechanism of the applicator. The cocking spring is housed in a tube which includes a threaded cap [261] for adjusting spring compression. A U-shaped spacer [244] sits upon the cocking rod with its arms preferably facing downward, and it is secured in place on the rod by a set screw collar [246.] These two components are shown in duplicate exploded away from the assembly to show their features.

The cocking mechanism also cocks a spring which when released powers a drive dog [258] which has a pawl [259] which operates similar to a walking foot of a sewing machine; it is pinned to the lower end of the drive dog. Thus with successive ram operations from above, applicator advances sets of terminals supplied to it in bulk strips, in an in-feed direction shown by arrow [238.] An illustration of a set of terminals [185] furnished on mylar tape is included in this figure. Preferred IDT terminals for use with this applicator and assembly system are designed to accept a wide range of wire sizes and configurations. A U-shaped spacer [244] sits upon the cocking rod with its arms preferably facing downward, and it is secured in place on the rod by a set screw collar [246.] These two components control the throw length of the cocking mechanism so that the drive dog swings back far enough for the pawl to engage and drive the slidable magazine by passing over and catching the next peak of the sawtooth profile of the magazine. Wider insulator housings, such as those having more lines or larger terminals or both will require more generous swings of the drive dog to operate the pawl, and sets of U-spacers may be fashioned in various lengths so that a desired throw length for a given connector width is made available.

One of the most preferred terminal designs is disclosed by the inventor in application Ser. No. 16/516,672 which issued on 28 Jan. 2020 as U.S. Pat. No. 10,547,125. This type of terminal includes an opposed pair of pincers [30] with the wire being inserted in a direction perpendicular to the pincers. The terminals also include jacket crimp ears [77.] The specific mating features of the contact are not within the scope of the invention, and may be rolled pins, blades, lugs, box-type contacts, duck-bill contacts, blade-on-beam designs, cantilever contacts or others known within the industry. In the figures, the particulars of the contact features are shown by a lozenge shaped volume [78] which represents any terminal contact configuration.

In the assembly system disclosed in this application, the terminals are lain horizontally and wires are lain atop each terminal. Then, the entire set of wires are forced into electrical interconnections in a single press from above. However, it is also within the scope of the invention to terminate wires to IDT terminals while these connector components are oriented differently, such as by a vertical rotating turret or carrousel system.

Figure 4B:
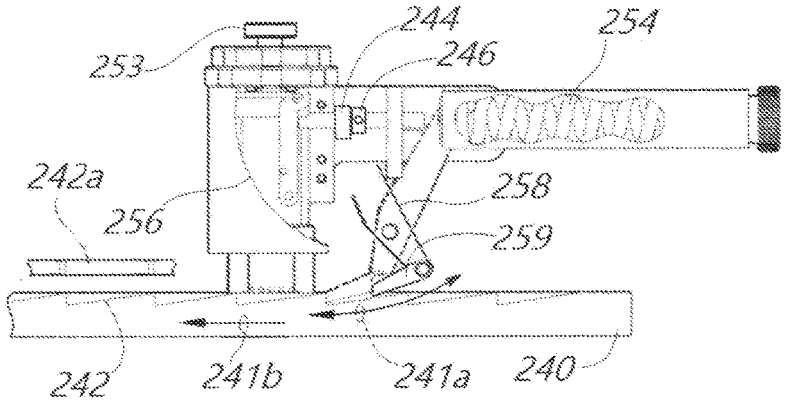
FIG. 4*b* shows a rear view of the spring feed applicator of FIG. 4*a* and the advancing motion of the magazine.

FIG. 4*b* shows a rear view of the spring feed applicator of FIG. 4*a* and the advancing motion of the magazine [240.] The ram presses down onto a threaded shank [253] seated onto top of the spring feed applicator. A cam follower rides along a guide which includes an arcuate profile [256] or "J" to cock the spring during the descent of the ram. The spring [254] is housed in a tube which includes a threaded cap for adjusting spring compression. The magazine is indexed along a direction indicated by arrow [241*b*] as the cocking and releasing of the spring drives a drive dog [258] and pawl [259] in an oscillating arc shown by arrow [241*a*.] Successive motions of the drive dog and pawl index the pawl over successive crests of the sawtooth profile, which advances the magazine by one connector bay per cycle. Also, in addition to a sawtooth profile [242,] a variant magazine having complementary rectangular wells [242*a*] punctuated by fences between the wells may also be driven by the pawl passing over a fence, dropping into a well, and then catching the root of the fence as a traction drive.

Figure 4C:
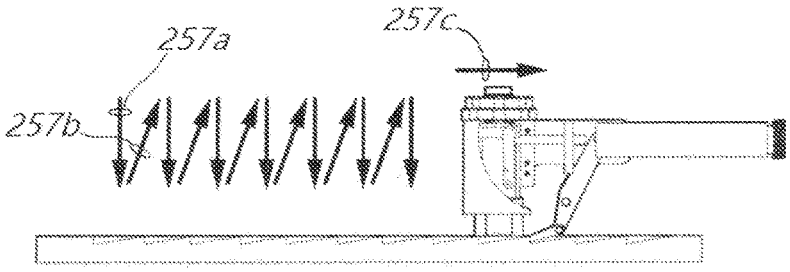
FIG. 4*c* shows an alternative assembly operating mode of the applicator tool in which the magazine is fixed, and the applicator is coupled for to the workbench for lateral motion along the length of the magazine.

FIG. 4*c* shows an alternative assembly operating mode of the applicator tool in which the magazine is fixed, and the applicator is coupled for to the workbench for lateral motion along the length of the magazine. Successive down-strokes of the ram (indicated by the arrow [257*a*,]) terminate and form the connectors in one bay while cocking the spring and the drive dog.

On the upstroke of the ram, the drive dog laterally translates the applicator (as indicated by the arrow [257*c*,]) and the ram is moved in tandem along the backwall by automatic control. The upstroke of the ram combined with its lateral motion chasing the applicator is shown by diagonal arrow [257*b*.] Also, besides using a spring cocked by energy delivered by the ram, the applicator may also be powered by pneumatic or hydraulic means or by an electric solenoid. These alternate means may also advance the bulk supply of terminals supplied by strip, reel, or tape.

Figure 5A:
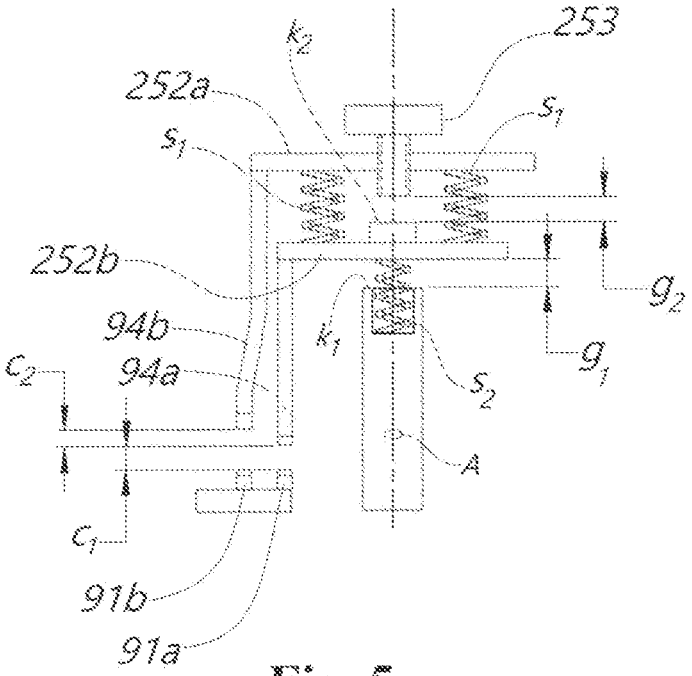
FIGS. 5*a*, 5*b*, and 5*c* show the timing of an applicator configured to perform a first IDT insertion operation and a second jacket crimp operation separately.
Figure 5B:
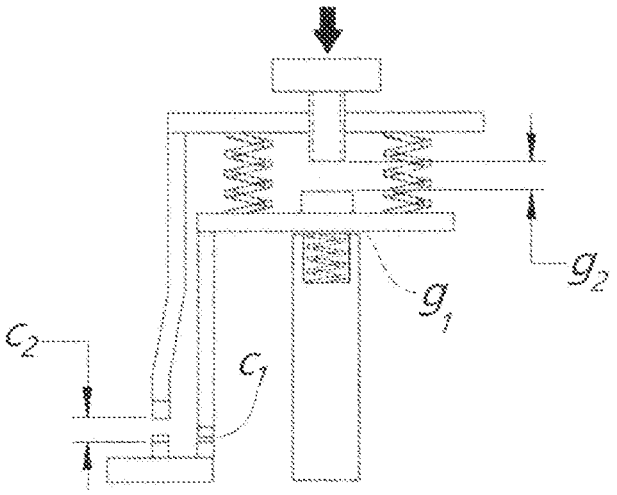
Figure 5C:
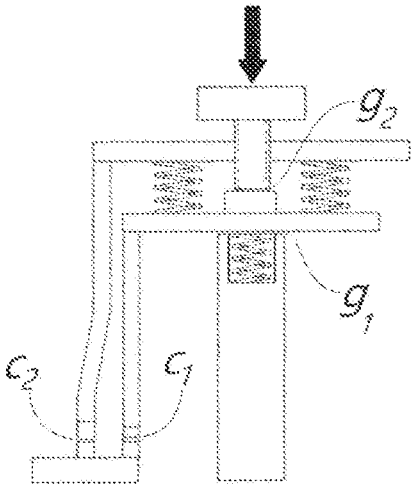

FIGS. 5*a*, 5*b*, and 5*c* show the timing of an applicator configured as a wire terminating apparatus which performs a first IDT insertion operation and a second jacket crimp operation separately. Beginning with FIG. 5*a*, the terminal (not shown) is lain upon two anvils, of which a first anvil [91*a*] is for the tool which forcibly inserts a wire lain atop the terminal into its IDT pincers. The mutually opposed pincers trap the wire from axial excursion over the life of the interconnection. However, with no other crimping or forming of the contact, at any time before the jacket crimp is made, the wire may be wrested from the pincer jaws and removed if such a rework operation is required. The first anvil is registered with the wire insertion tool and in contact with the second pressure surface so that force from the ram is directed to the insertion operation. Although the applicator may be used for many types of wire insertion tools, in this configuration the wire insertion tool is an insulation displacement terminal (IDT) insertion tool.

The jacket crimp wings of the terminal are lain atop a second anvil [91*b*] registered with the crimp forming tool. The threaded shank [253] of the applicator tool is height adjustable. The first threadably adjustable disc [252*a*] controls the height of the jacket crimp forming tool and its gap height above the terminal to be crimped. A first elastic member or set of springs [s1] is or are disposed between the first adjustable disc and the second adjustable disc [252*b*] leaving a gap height [g2] closable by overcoming the elastic compression forces in [s1.] Gap [g2] is adjustable by rotating the first disc or the threaded shank, and gap [g1] is adjustable by rotating the second disc. The first elastic member is compressible along an axial direction [A] and disposed between the first pressure surface and the second disc. The crimp forming tool is in contact with the first pressure surface.

The jacket crimp forming tool [94*b*] is connected to or impinged from above by an underside surface which is a first pressure surface of the first adjustable disc. The IDT insertion tool [94*a*] is connected to or impinged from above by an underside surface which is a second pressure surface of the second adjustable disc. The stack of discs rest upon a second elastic member or set of springs [s2] disposed between the second adjustable disc and a stationary member of the applicator, leaving a gap height [g1] closable by overcoming the elastic compression forces in [s2.] The spring rate of the first elastic member [s1] is greater than that of the second elastic member [s2,] and preloads may also be incorporated into either or both [s1] and [s2] so that force or downward displacement applied to the shank will close gap [g1] before little or any extent of gap [g2] is closed. The gap [g1] is related to the tooling gap [c1] between the IDT insertion tool and its anvil, while the gap [g2] is related to an additional tooling clearance [c2] between the jacket crimp tool and its anvil, minus the IDT tooling clearance [c1.] The second elastic member is compressible along the axial direction and in contact with the second pressure surface.

In an exemplary embodiment using patented IDT pincer terminals, individual insertion forces for wires ranging in size from 26 AWG to 14 AWG inclusively may be as small as 1 ounce per mated line. Thus for a 10-line connector or connector wafer (a wafer being comparable to a single row receptacle,) the force sustained by spring member [s2] when gap [g2] remains open need be no more or only little more than the weight of the discs, forming tools, the shank and the compressible member [s1,] plus 10 ounces of force. This first forming step may begin when the second disc is spaced apart from a first stop [k1] in an axial direction to form a first gap [g1.] For controlling the next forming step described below, the shank has an end face axially spaced apart from a second stop [k2] attached to the second disc to form a second gap [g2.] In optional arrangements of these control features in accordance with the invention, the first elastic member may also be disposed between the first pressure surface and this second stop, and the second stop may threadably coupled to the second disc to allow adjustment of gap [g2.]

In FIG. 5*b* the ram has pushed the top of the applicator tool partway down. In applying only the additional force required to overcome [s2,] the gap [g1] closes while gap [g2] remains open. At the terminal, the IDT insertion tool has inserted the wires into their terminals. As the first tooling gap [c1] closes, the pincer contacts lacerate the wire jackets to expose and bite into the conductive strands of the wires. For a linear set of wires arrayed upon their IDT contacts, the insertion operation is a single act effecting a gang insertion of the plurality of wires. Gaps [g2] and [c2] remain unclosed at this stage.

At this point, the downward motion of the ram may be paused so that electrical verification or validation may be performed on the set of terminals. Electrical access to the terminals at this stage is explained more fully below, but may preferably comprise pogo pins positioned in the assembly fixture either within or near the anvils to contact the terminals from below, or pins positioned within the connector headshell in electrical contact with the terminals before the forming operation begins.

FIG. 5*c* shows that upon receiving an acceptable electrical continuity test (if performed,) the descent of the ram is resumed. Gap [g2] closes under the additional force, which is routed through the first disc to drive the jacket crimp forming tool, which also acts in gang on the set of wires. Wire termination is now complete.

In summarizing the steps shown in FIGS. 5*a*, 5*b*, and 5*c*, a method for terminating a plurality of wires to a plurality of (IDT) terminals is disclosed, comprising the steps of a. providing a wire terminating apparatus comprising:
   - a first disc having a first pressure surface,
   - a second disc having a second pressure surface spaced apart from a first stop in an axial direction to form a first gap,
   - a first elastic member compressible along an axial direction and disposed between the first pressure surface and the second disc,
   - a second elastic member compressible along the axial direction and in contact with the second pressure surface,
   - a shank passing through and threadably coupled to the first disc and having and end face axially spaced apart from a second stop attached to the second disc to form a second gap, and
   - a first anvil registered with a wire insertion tool which is an (IDT) insertion tool in contact with the second pressure surface, b. positioning a terminal having a wire receiving site which comprises an IDT contact portion with the IDT contact portion in registration with the first anvil, c. providing a wire and positioning the wire in contact with the IDT contact portion of the terminal, and d. displacing the second disc in the axial direction so that the IDT insertion tool inserts the wire into the IDT contact portion of the terminal.

Variations and elaborations on this method also reside within the scope of the invention. Timing the closure of the first set of tools upon their anvils to occur before closure of the second set of tools and anvils may be effected by selecting a spring rate of the first elastic member which is greater than a spring rate of the second elastic member. When using both a wire insertion tool and a jacket crimp tool, the terminals preferably have their IDT portions positioned in registration with their first anvils before closure of the first set of tools, with the wire positioned in registration with the IDT portion. Then for the jacket crimp step following, the jacket crimp portions are positioned in registration with their second anvils and the wire positioned in registration with the jacket crimp portion of the terminal, and with the crimp forming tool in contact with the first pressure surface, before closure of the second set of tools, which may be described as displacing the first disc in the axial direction so the crimp forming tool crimps the wire by the jacket crimp portion of the terminal.

Figure 6A:
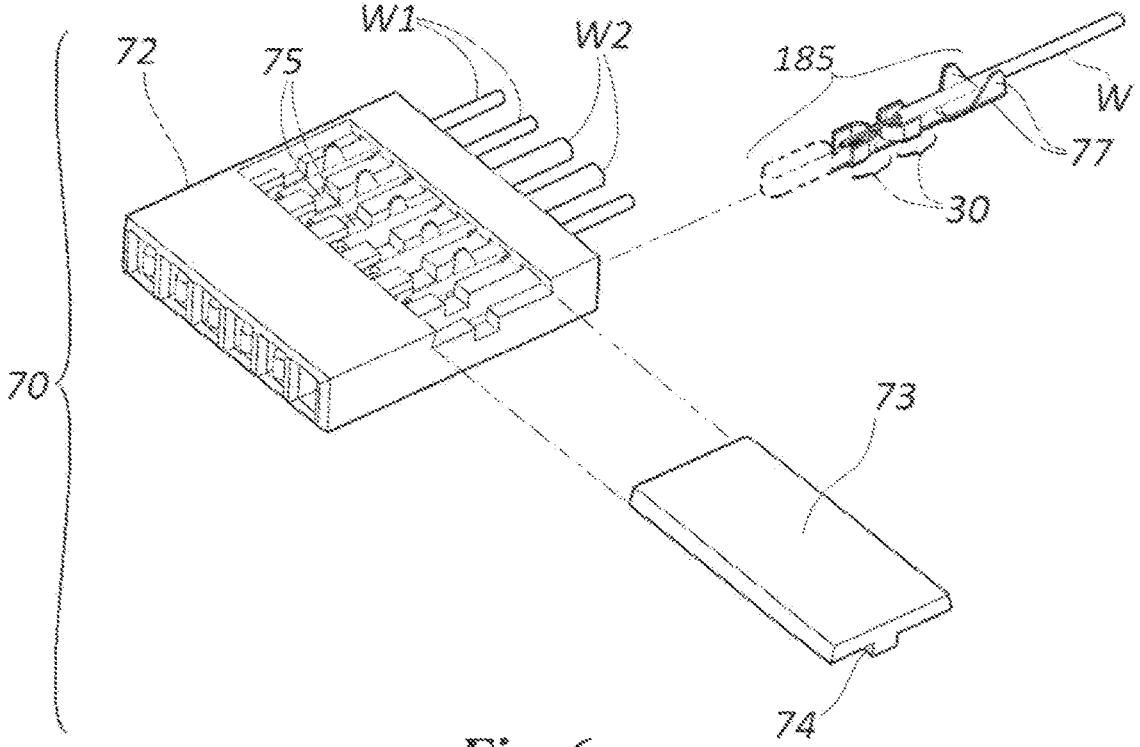
FIG. 6*a* shows a cable end connector assembly having terminals, an insulator housing, and a terminal keeper bar.

FIG. 6*a* shows a cable end connector assembly having terminals [185,] an insulator housing [72,] and a terminal keeper bar. Each terminal includes flexible beam pincer sections [30] for receiving a wire [W,] and jacket crimp wings [77.] The terminal end [78] may incorporate end configurations such as pin-receiving "duck bill" pairs of beams, formed rolled pins, or other common configurations, so in this and following figures it is shown as a broken-line feature because the exact details of these terminal ends are not specifically within the scope of the invention.

The cable end connector includes wires of different sizes [W1, W2,] which are advantageously received into the same size terminal, because a terminal in accordance with the invention is capable of receiving a wider range of wire sizes than the rigid slot designs discussed previously. Also, although adequate retention force is designed into connector assemblies, for some automotive applications a keeper is a specified requirement as a redundant safety means to prevent inserted terminals from being pushed out the back of the insulator housing when it is plugged in to a complementary mating device such as a shrouded header (not shown.) One effective keeper [73] as shown in this figure includes a transverse ridge [74] which slides into a transverse slot [75] in the insulator housing which in this example extends behind the pincers of the terminals when they are fully inserted. Once the keeper bar is installed, the terminal cannot be pulled out of the connector insulator housing, and typically the design is robust enough so that the wire will part before the terminal can be dislodged from the insulator housing. Some designs even have more than one keeper bar, or a redundant keeper lock to prevent a keeper bar from slipping out of the connector insulator housing.

Figure 6B:
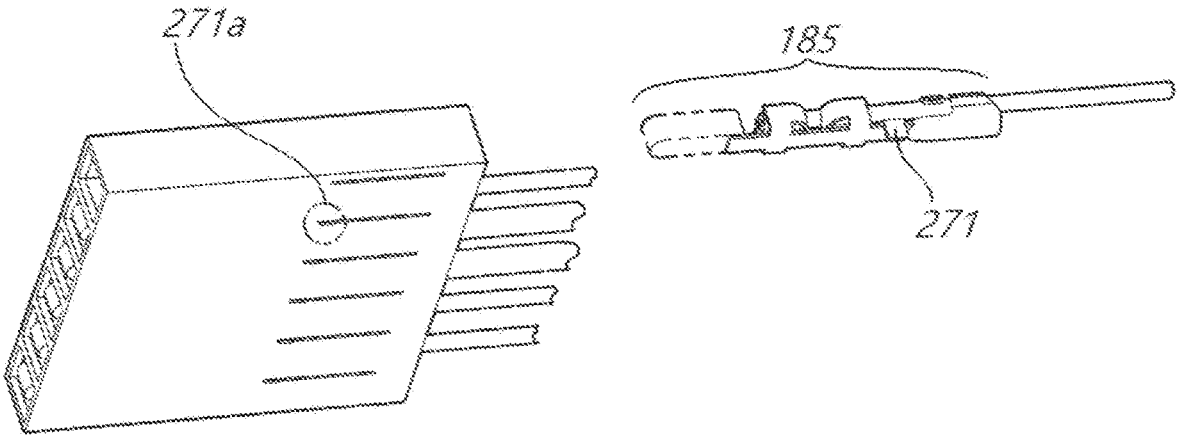
FIG. 6*b* shows an alternative embodiment of a connector assembly or subassembly in accordance with the invention.

FIG. 6*b* shows an alternative embodiment of a connector assembly or subassembly in accordance with the invention. An IDT terminal [185] includes a tail portion [271] which extends outside of or is accessible through an aperture in the connector insulator housing. One terminal is shown extracted from the housing while the other terminals remain assembled within the housing. The protruding portion of the tail is shown extending out of an aperture at [271*a*.] In this embodiment the apertures are slots which allow access to the terminal tail while it is at an initial inserted position at a first end of the slot and also available at a fully seated position within the insulator housing, where the tail would reside at the other end of the slot.

Terminals may be designed with barbs or other snap-in retention features which lock the terminals into complementary cavities formed within the insulator housing. Some customer requirements specify that the retention force of a fully inserted terminal should exceed even the breaking strength of the wire. In the event of an unsuccessfully terminated wire becoming fully inserted and locked into the housing, or in a miswire error event when a terminated wire is inserted into the wrong aperture of an insulator housing, the unwanted terminal may be difficult or impossible to remove without damaging or destroying the housing. Some customer requirements specify that miswired headshells are not to be repaired, but cut off and scrapped instead; others specify that the entire harness must be scrapped at that point, causing material waste and loss of manufacturing profit.

By allowing electrical verification tests to occur before final insertion of the terminals, miswiring or other electrical faults may be diagnosed and corrected with minor and reversible rework, which avoids waste and loss.

Figure 6C:
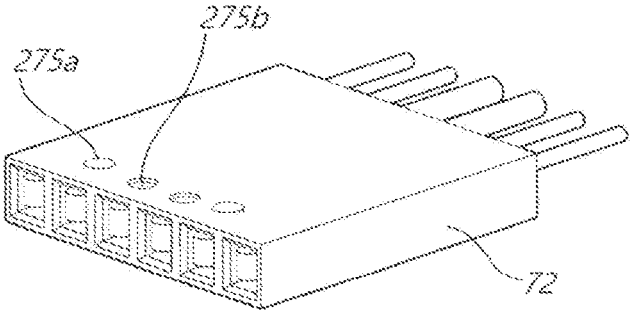
FIG. 6*c* shows another alternative embodiment of a subassembly in accordance with the invention.

FIG. 6*c* shows another alternative embodiment of a connector subassembly in accordance with the invention. In this embodiment an insulator housing [72] is one of a plurality of one-row "wafers" which will be assembled into a stack to form a multiple-row connector assembly. Mating surfaces of the wafers may include polarity features such as protrusions [275*a*] or recesses [275*b*] or other inter-mateable sets of complementary features which enforce correct assembly stacking and reject or preclude assembly errors. Making mistakes impossible to commit is a lean manufacturing technique called 'poka-yoke.'

Figure 6D:
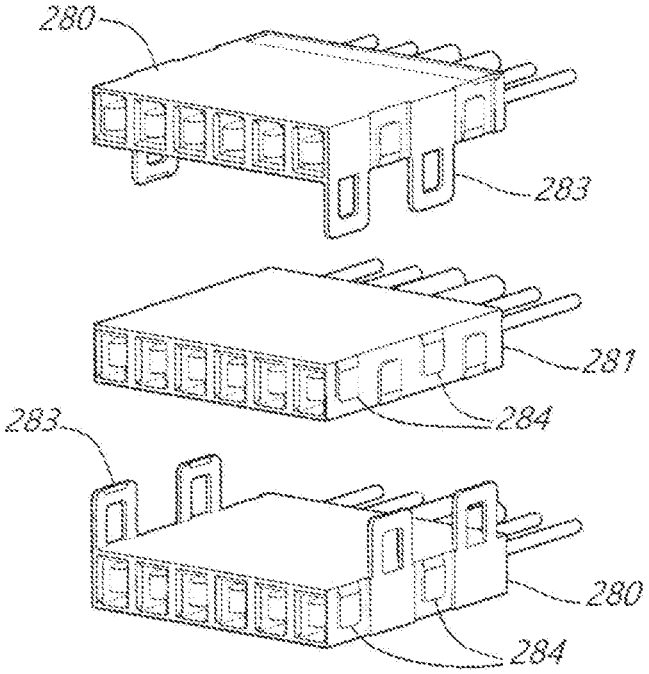
FIG. 6*d* shows an embodiment of a multiple-row connector assembly with its wafers exploded apart.

FIG. 6*d* shows an embodiment of a multiple-row connector assembly with its wafers exploded apart. Two of the wafers [280] are of a first configuration that include hermaphroditic sets of mateable features which in this case includes latches [283] and latch receiving sites [284.] A two-row connector may be manufactured with both rows molded from the same headshell mold tool, which reduces manufacturing costs. A second wafer configuration [281] includes only latch receiving sites, and becomes the middle wafer of a three-row stack. Additional rows may be built up using a third configuration which includes latch receiving sites complementary to the latches of the first wafer style and having other latches oriented to grasp onto the latch receiving sites of the second wafer style, while having no latch receiving sites. Combinations of these three wafers styles may be selected to create assemblies having four or more rows.

Figure 6E:
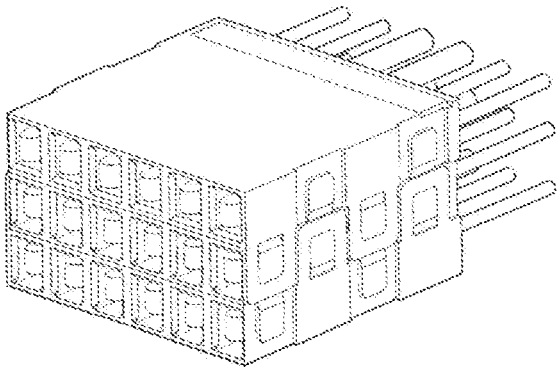
FIG. 6*e* shows the multiple-row connector assembly of 6*d* with its wafers snapped together.

FIG. 6*e* shows the multiple-row connector assembly of 6*d* with its wafers snapped together.

Figure 7A:
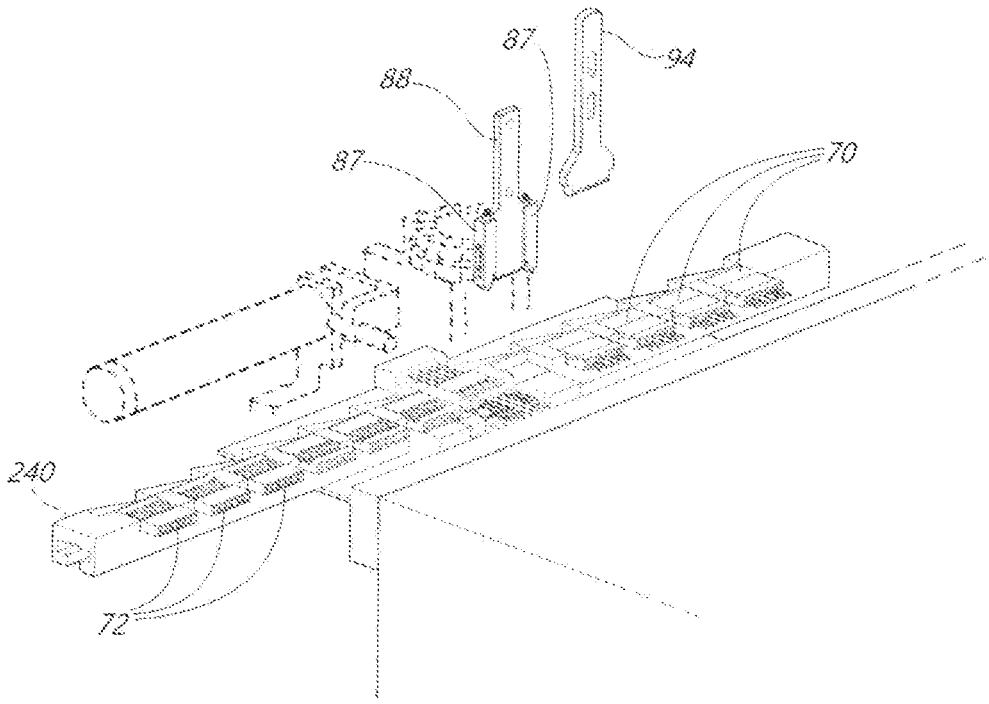
FIG. 7*a* shows a magazine with some of its bays populated with connector insulator housings ready for assembly, and finished connectors in other bays, and one connector and its terminals and wires in an intermediate assembly stage.

FIG. 7*a* shows a magazine [240] with some of its bays populated with connector insulator housings [72] ready for assembly, and finished connectors [70] in other bays, and one connector and its terminals and wires in an intermediate assembly stage. The applicator tool is partially shown in broken lines, and it is configured to operate a jacket crimping tool [94] and an IDT gang-insertion tool [88.] The insertion tool includes vertically spring-loaded side bars [87] at both its ends to provide lateral stability to vanes in the assembly fixture which register the array of terminals so that they are on-pitch regardless of core size or conductor size.

These operations may be performed simultaneously or in a sequence, or preferably the IDT gang insertion is performed first, then electrical continuity or performance tests are performed to verify that proper wire terminations have been achieved, before the wires are crimped to their terminals. Besides continuity, other tests such as contact resistance, dielectric withstanding voltage, time domain reflectivity (TDR,) crosstalk, and signal integrity and propagation delay tests may also be performed. If the wire harness being assembled includes active components which are already connected elsewhere, these may also be checked for proper function and performance. A cost and time saving advantage provided by the invention is that if an electrical failure is discovered during these assembly steps, replacing terminals or removing wires from IDT contacts as rework is simpler and lower cost than discovering electrical failures after more irreversible value added assembly steps, such as insertion of barbed terminals into plastic housings or after assembly of one-time snap-in or self-locking components have been invested into the wire harness being assembled.

Figure 7B:
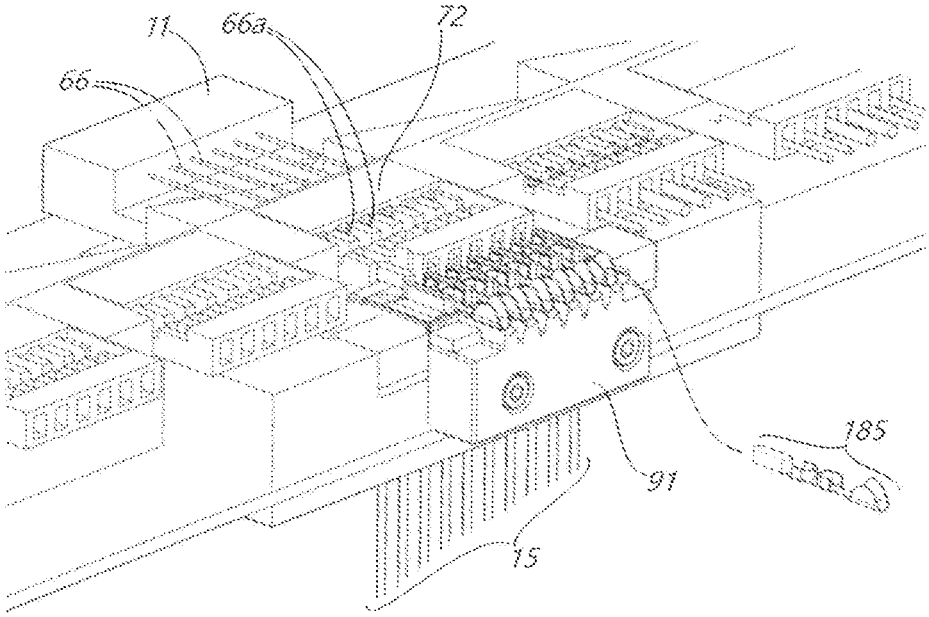
FIG. 7*b* shows the connector of FIG. 7*a* in its intermediate assembly stage with other components omitted for clarity.

FIG. 7*b* shows the connector of FIG. 7*a* in its intermediate assembly stage with other components omitted for clarity. Terminals [185] are lain atop an anvil block [91] which includes form controlling surfaces for both the wire jacket crimp operation and an underside bolster to support the IDT pincer contact portions of the terminals while wires are being inserted into them from above. The anvil surfaces may optionally and preferably comprise non-conductive materials, non-conductive surface treatments such as certain anodized coatings, or insulating adhesive polyimide strip which is sometimes called Kapton®. Electrical test leads [15] are connected through a header [11] affixed to an application specific assembly fixture which includes a plurality of electrically conductive probes [66] which may be solid pins or may be spring-loaded 'pogo' pins or other axially compliant contacts or compliant cantilever contacts. The pins pass through the connector insulator housing [72] so that their tips [66*a*] will contact the terminals when the terminals are slid forward into initial or partial insertion into the housing.

Figure 7C:
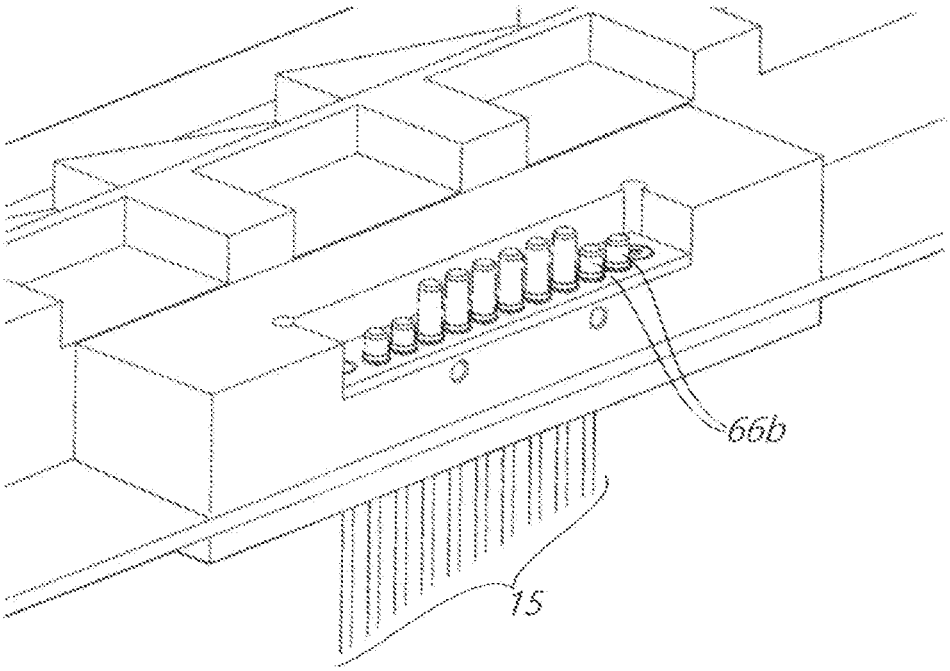
FIG. 7*c* shows an electrical testing substructure in accordance with another alternate embodiment of the invention.

FIG. 7*c* shows an electrical testing substructure in accordance with another alternate embodiment of the invention. Rather than passing through an application specific test and assembly fixture, the test leads [15] may pass through the anvil block (omitted in this view) to directly contact and electrically interrogate the terminals while they are in position on their anvils. Connectors or wafer housings having various numbers of lines in them will use magazines having appropriately sized bays, and the number and configuration of adjustable compliant pins [66*b*] may be raised to engage with the assembly fixtures or lowered when not required. Although the invention is not limited to the number of pins shown in this figure; the substructure as shown may accommodate connectors or wafers having up to 10 lines or more.

Figure 8A:
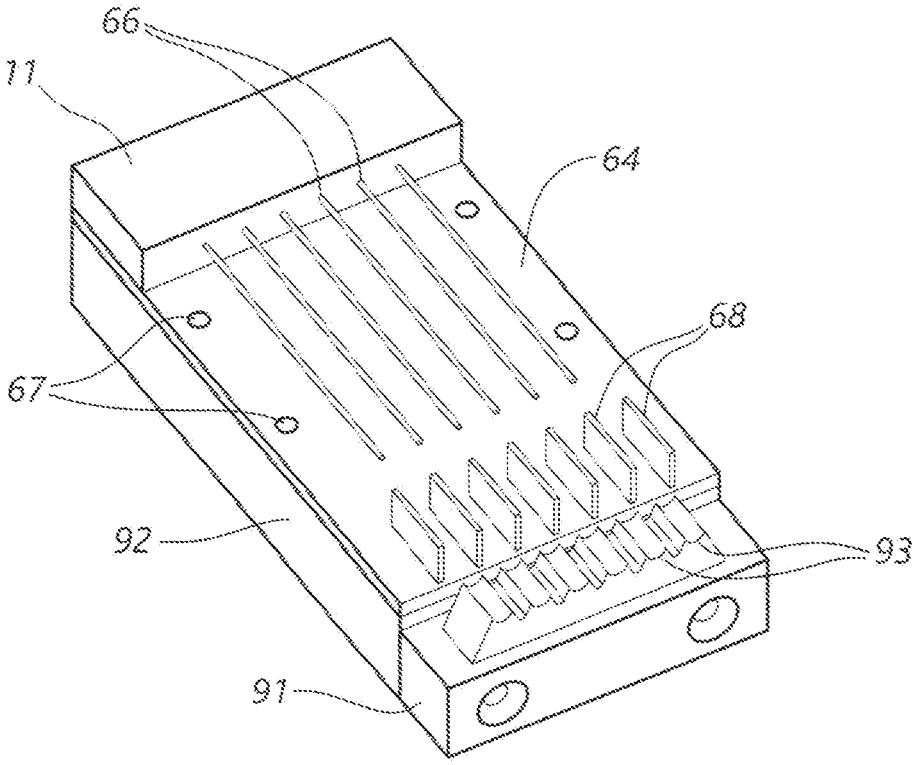
FIG. 8*a* shows a connector assembly fixture in accordance with the invention.

FIG. 8*a* shows a connector assembly fixture in accordance with a parent application of the invention, as designed for mass termination of insulation displacement termination (IDT) terminals and concurrent electrical testing. Assembly may begin with a connector insulator housing provided with partially inserted IDT terminals, or IDT terminals may receive wires into their flexible beam pincers, but not yet have their jacket crimp wings folded over to permanently capture their wires. The terminals may be arranged into slots defined between a linear array of parallel vanes [68] to stage them for insertion into a connector insulator housing. A header [11] affixed to an application specific assembly fixture [64] includes a plurality of electrically conductive probes [66] which may be solid pins or may be spring-loaded 'pogo' pins or other axially compliant contacts or compliant cantilever contacts. The application specific assembly fixture is made of a non-conductive material like plastic such as ABS, polycarbonate, polyethylene or nylon or other such plastics, and includes a linear array of spaced apart vanes [68] for receiving terminals between them and spacing them on a pitch complementary to the pitch of terminal-receiving apertures of a connector head shell. The application specific assembly fixture also includes an array of alignment holes [67] which receive pegs or pin features on a snap-on cover. An anvil tool [91] comprises a series of crimp forming sites [93] which control the rounded underside surface of the crimp wing portion of terminals while these wings are being formed over to permanently secure each wire to its IDT terminal. The anvil tool preferably includes attachment means such as countersunk holes for screws to attach it securely to a rigid base [92] which is further secured to a work bench or other assembly surface of a work space. The application specific assembly fixture is also secured to this base.

Figure 8B:
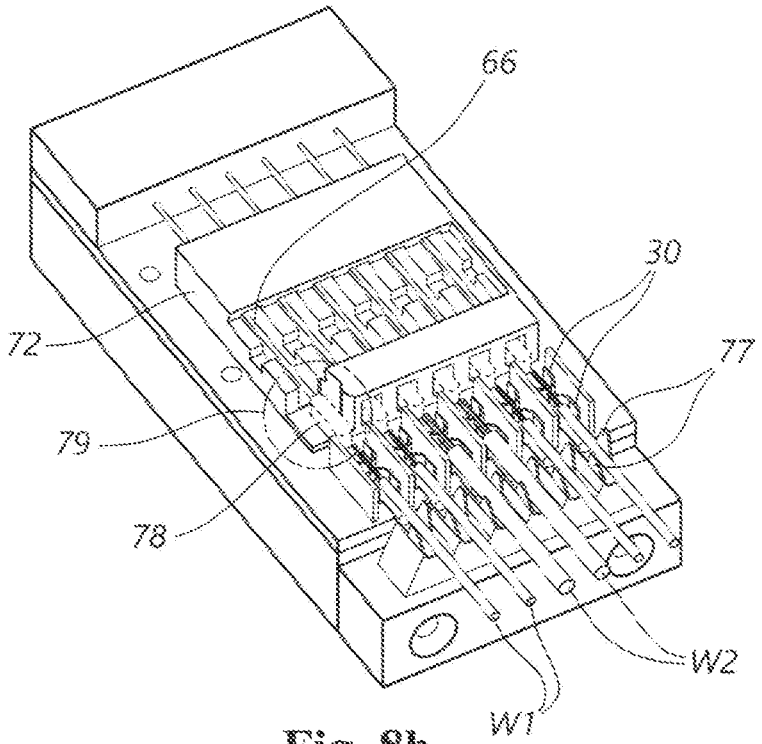
FIG. 8*b* shows a cable end connector assembly step wherein terminals may be electrically tested before being inserted into a connector insulator housing.

FIG. 8*b* shows a cable end connector assembly step wherein terminals may be electrically tested before being inserted into a connector insulator housing [72.] Several IDT terminals are shown having had wires inserted into their pairs of flexible pincers [30.] This figure shows how a single terminal design is able to accommodate different wire sizes [W1] and [W2.] At this assembly stage an IDT insertion tool (not shown) has pressed the wires into the pincer contact sections of the terminals, while these terminal sections were residing in the slots defined between the vanes of the application specific assembly fixture. The crimp wings [77] of the terminals have not yet been formed over to trap the wires which have been inserted into the pincer sections. Also in this view, the wires are shown with their insulation stripped in the vicinity of the pincer sections so as to illustrate their pinching effect and that the wire cores received by the pincers may vary in size and composition. In practice the pincers lacerate the jackets and make contact with the conductor strands or cores of the wire without it being necessary to strip or prepare the wire ends. Indeed, the very purpose of insulation displacement connectors is to eliminate the time and costs spent in wire end preparations such as stripping or tinning.

Inset [79] shows a portion of the connector insulator housing broken away to reveal the inventive IDT terminals staged but not fully inserted. The terminal end [78] or contact point is shown as a broken-line lozenge volume because the specifics of terminal end configurations are outside the scope of the invention. They may include many different contact interface designs, such formed rolled pins or duck-bill contacts for receiving header pins. In the assembly step shown, the insulator housing has been positioned so that the test probe pins [66] pass through it, and the inventive IDT terminals are advanced enough so that their terminal ends are mated onto the probe pins. No snap-in, locking, press fits, or force fits of the terminals into the insulator housing have yet occurred at this step shown. As yet another time saving step, the insulator housing shown in this figure may be delivered to the assembly fixture with its set of IDT terminals already partially inserted so that retention features in the terminal may be partially engaged.

In this figure at least one of the plurality of electrically conductive probes resides within at least one of the terminal receiving apertures in the connector insulator housing. However, it is preferred that if all the probes are reasonably within the same length and all the terminals are inserted into the insulator housing to the same partial depth, then all the probes should be in good electrical contact with their terminals, especially when at least a portion of a terminal is received within a terminal receiving aperture in the connector insulator housing.

Figure 8C:
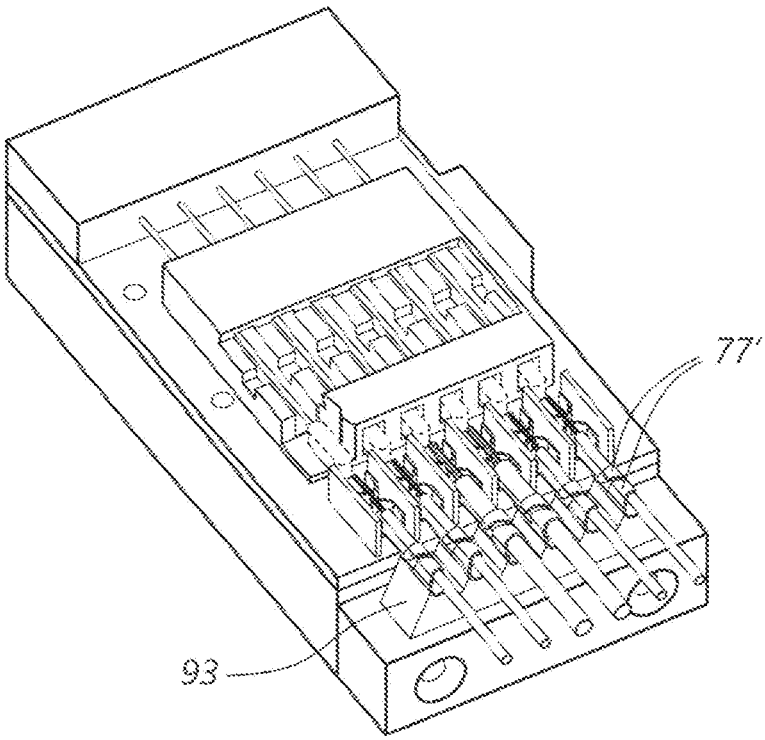
FIG. 8*c* shows another view of a cable end connector assembly step after the crimp wings formed over into a permanent, assembled condition.

FIG. 8*c* shows another view of a cable end connector assembly step after the crimp wings [77'] are shown formed over into a permanent, assembled condition and with the jacket crimp portions of the terminals having been curled down over the wire jackets while being supported by crimp forming sites [93] of the anvil tool.

Electrical tests may be performed concurrently during the assembly process anytime while the terminals are in contact with their test probes. An entire cable harness assembly may be tested and verified before irreversible assembly steps are taken. Note that the contacts still remain electrically mated with the test probe pins so that if desired, additional redundant electrical tests may further verify that the crimp process did not harm the terminals.

The advantage of being able to test and assure signal integrity before steps are taken which are difficult or impossible to undo and try again substantially reduces per unit cable costs by reducing or eliminating costly rework steps such as pulling and replacing a terminal which has been fully inserted into its insulator housing, especially for a design having retention features which must be defeated in order to extract it. Once signal integrity testing has qualified all terminals in the assembly as functional, the jacket crimp wings of the terminal may then be formed over to clamp and hold the wires as a redundant safety and electrical quality assurance feature. The array of contacts may then be pushed forward as a gang and mass-inserted into the insulator housing, and the depth stops maintain the housing in position until the proper terminal insertion depth is achieved. Even after full insertion, yet another redundant battery of electrical tests may further again that the terminal insertion process was successful. Because a redundant series of electrical tests may be repeated at each process step, loss of control of quality of any individual step may be detected and corrected quickly.

Figure 9A:
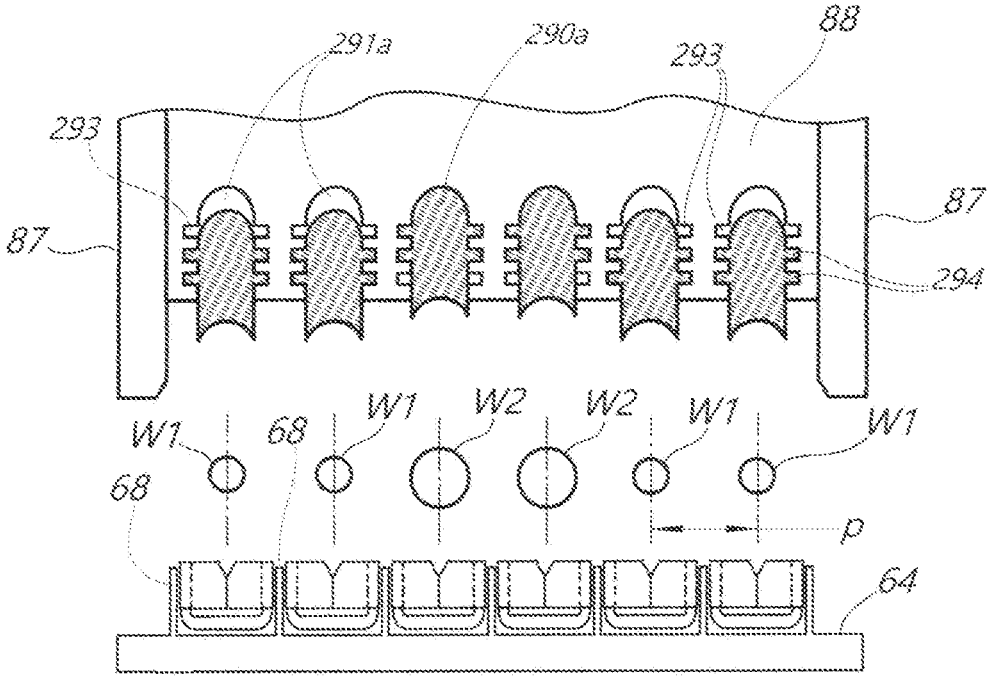
FIG. 9*a* shows an IDT insertion tool for terminating wires to contacts in accordance with the invention.

FIG. 9*a* shows an IDT insertion tool [88] for terminating wires to contacts in accordance with the invention. The tool includes vertically spring-loaded side bars [87] at both its ends to provide lateral stability to the vanes [68] which register the array of terminals so that they are on-pitch regardless of core size or conductor size. Additional lateral locking features may be included to prevent the side bars from splaying apart laterally. The side bars bottom out onto the surface of the application specific assembly fixture [64] first and then stop descending, while the rest of the insertion tool continues to push the set of wires down to complete the insertion process. During the insertion and termination process the flexible beams of the pincers may operate independently, especially when wires having a diversity of wire core diameters are being received for termination. This is accomplished by controlling the overall width dimension taken from the outer edge of the first vane and spanning across to the outer edge of the last vane of the application specific assembly fixture installed in the work space. The spring-loaded side bars also preferably include chamfers or lead-in features to capture the outermost vanes during the descent of the insertion tool, and prevent damage such as stubbing or crushing these vanes.

The application shown includes mixed wire sizes [W1] and [W2] which are all received into a single design and size of the inventive IDT terminal. The wires are assembled on a contact pitch [p,] and a common value for p is 0.156 inches. Also of note, no side-action tooling is required to complete the termination process. Instead, by securing the sidewalls of the flexible beam pincers by means of the vanes and the side bars of the insertion tool, the flexible beams may operate independently and adjust to whatever size wire is being received and may also, during insertion or at any time in service, adjust to any rearrangement of a conductive bundle over time.

In this tool, the IDT insertion teeth [290*a*] are adjustably received within the tool for vertical adjustment of the depth of insertion of the wires into their pincer contacts. Quick production changeovers from one wire size to another may be effected by raising or lowering the height of the insertion teeth. The tool includes a plurality of cavities [291*a*] each having a regularly spaced apart series of alveolar sidecuts

[293.] Each adjustable tooth includes a complementary set of regularly spaced series of protuberances [294] which are receivable into the sidecuts in the tool cavity at any various desired and adjustable height. The teeth are retained in their cavities by retention means beyond the scope of this specification, but any number of means may be fabricated by a tool maker of average skill in the art. Retention examples may include set screws, temporary adhesives, or blocking members which prevent the teeth from disengaging their protuberances from the complementary sidecuts.

Figure 9B:
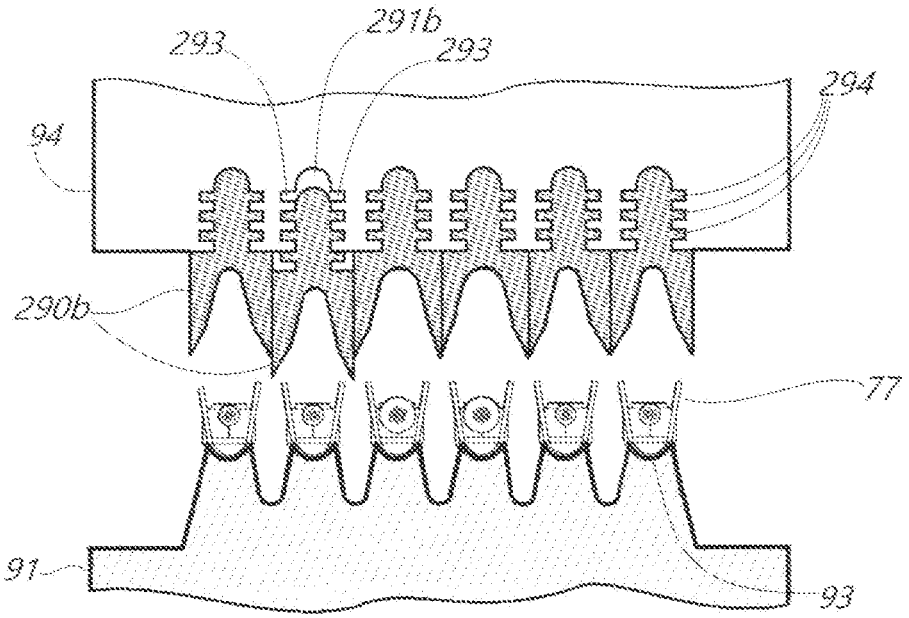
FIG. 9*b* shows a set of forming tools for closing crimp wings onto wire jackets of an array of wires held within an application specific assembly fixture, in which the upperside forming tools are adjustable by height.

FIG. 9*b* shows a set of forming tools for closing crimp wings [77] onto wire jackets of an array of wires held within an application specific assembly fixture, in which the upper-side forming tool [94] includes a plurality of crimp tools [290*b*] which are adjustable by height. The lower-side tool [91] includes a plurality of anvils [93] which support the underside of the terminals while the crimp wing membranes are being rolled over and formed by the upper-side tool. The tool includes a plurality of cavities [291*b*] each having a regularly spaced apart series of alveolar sidecuts [293.] Each adjustable tooth includes a complementary set of regularly spaced series of protuberances [294] which are receivable into the sidecuts in the tool cavity at any various desired and adjustable height.

Figure 9C:
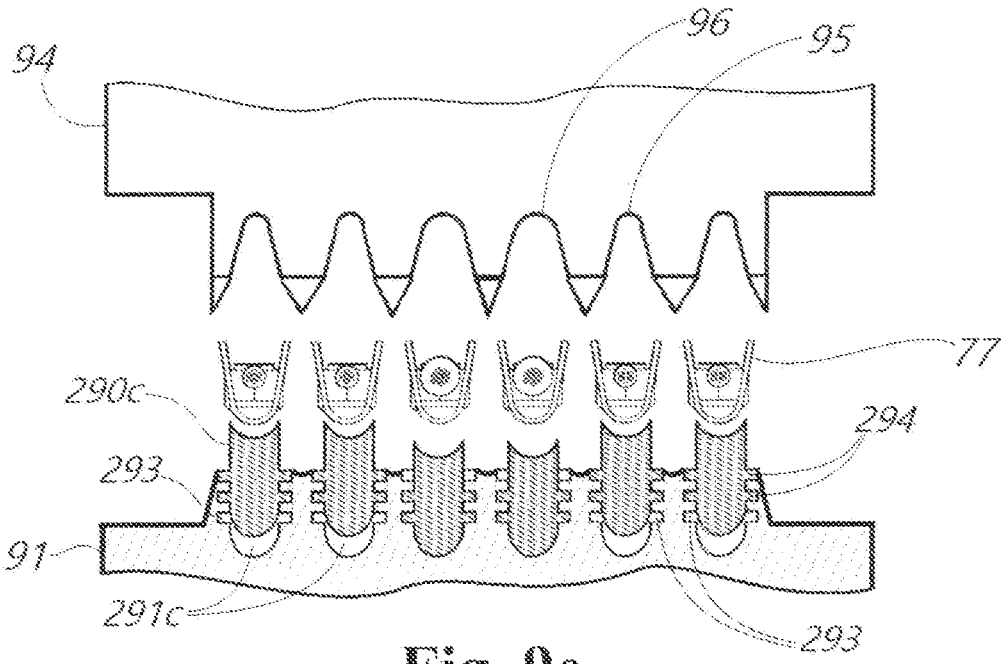
FIG. 9*c* shows a set of forming tools for closing crimp wings onto wire jackets of an array of wires held within an application specific assembly fixture, in which the anvils are adjustable by height.

FIG. 9*c* shows a set of forming tools for closing crimp wings onto wire jackets of an array of wires held within an application specific assembly fixture, in which the anvils are adjustable by height. The tools preferably include an anvil tool [91] which comprises a plurality of anvil-receiving cavities [291*c*] which receive a series of height adjustable anvils [290*c*] which include crimp forming sites to control the rounded underside surface of the crimp wing portion while the wings are being formed. Each adjustable tooth includes a complementary set of regularly spaced protuberances [294] which are receivable into sidecuts [293] in the tool cavity at any various desired and adjustable height. The teeth are retained in their cavities by retention means which may be fabricated without undue experimentation.

An upper-side tool which is a crimping punch [94] includes downwardly open arch features [95, 96] which are sized to the crimp wings and the final diameter of the wire jacket crimps when they are all squeezed shut between the anvils and overhead arches, which curl the wings down and around the wire jackets. The upper-side tool in this figure tool may also include height adjustable teeth in cavities having sidecuts as explained in FIG. 9*b*. The fine-cut height adjustable features are made possible to use when the IDT insertion force for the wires is very small.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

What is claimed is:

1. A wire terminating apparatus, comprising:

a first disc having a first pressure surface, a second disc having a second pressure surface spaced apart from a first stop in an axial direction to form a first gap, a first elastic member compressible along said axial direction and disposed between said first pressure surface and said second disc, a second elastic member compressible along said axial direction and in contact with said second pressure surface, a shank threadably coupled to said first disc and having an end face axially spaced apart from a second stop attached to said second disc to form a second gap, and a first anvil registered with a wire insertion tool in contact with said second pressure surface.

2. The wire terminating apparatus of claim 1, wherein said first elastic member is also disposed between said first pressure surface and said second stop.

3. The wire terminating apparatus of claim 1, wherein said second stop is threadably coupled to said second disc.

4. The wire terminating apparatus of claim 1, wherein said wire insertion tool is an insulation displacement terminal (IDT) insertion tool.

5. The wire terminating apparatus of claim 1, further comprising a second anvil registered with a crimp forming tool in contact with said first pressure surface.

6. The wire terminating apparatus of claim 1, wherein a spring rate of said first elastic member is greater than a spring rate of said second elastic member.

7. The wire terminating apparatus of claim 1, further comprising a slidable magazine having bays for receiving insulator housings.

8. The wire terminating apparatus of claim 7, wherein said wire terminating apparatus further comprises a drive dog powered by a release of a cocked spring, which said drive dog further comprising a pawl engageable with said slidable magazine.

* * * * *